US007188977B1

(12) United States Patent
Lough

(10) Patent No.: US 7,188,977 B1
(45) Date of Patent: Mar. 13, 2007

(54) EZ CLIP IT

(76) Inventor: Bonita Lough, P.O. Box 530, Fort Ashby, WV (US) 26719

( * ) Notice: Subject to any disclaimer, the term of this patent is extended or adjusted under 35 U.S.C. 154(b) by 47 days.

(21) Appl. No.: 10/896,404

(22) Filed: Jul. 21, 2004

Related U.S. Application Data

(60) Provisional application No. 60/491,445, filed on Jul. 31, 2003.

(51) Int. Cl.
*F21V 21/00* (2006.01)

(52) U.S. Cl. ..... 362/396; 362/252

(58) Field of Classification Search ..... 362/252, 362/396
See application file for complete search history.

(56) References Cited

U.S. PATENT DOCUMENTS 3,181,827 A * 5/1965 Sassin ..... 248/74.2
3,578,282 A * 5/1971 Olsen ..... 248/214
3,584,795 A * 6/1971 Baird ..... 362/396
3,599,916 A * 8/1971 Szabo ..... 248/73
3,599,918 A * 8/1971 Patchett ..... 248/85
3,861,632 A * 1/1975 Siilats ..... 248/224.7
6,494,594 B1 * 12/2002 Schroetter ..... 362/249
6,827,379 B2 * 12/2004 Hill et al. ..... 294/19.1
2003/0066938 A1 * 4/2003 Zimmerman ..... 248/301

* cited by examiner

*Primary Examiner*—Ali Alavi
*Assistant Examiner*—Hargobind S. Sawhney

(57) ABSTRACT

A gutter interface device for facilitating hanging of Christmas lights from a gutter. The gutter interface device includes a gutter interface portion and a cord interface portion. The gutter interface portion has a main vertical member for abutting a front edge of the gutter. The gutter interface portion has a lip-engaging member integrally coupled to the main vertical member. The lip-engaging member has a first horizontal extent coupled to said main vertical member, a vertical extent and a second horizontal extent, said lip-engaging member being u-shaped for abutting three sides of a lip of a gutter.

13 Claims, 2 Drawing Sheets

EZ CLIP IT

CROSS-REFERENCE TO RELATED APPLICATIONS

This application claims the benefit of U.S. Provisional Application No. 60/491,445, filed Jul. 31, 2003.

BACKGROUND OF THE INVENTION

The present invention relates to Christmas light clips and more particularly pertains to a new gutter interface device for facilitating hanging of Christmas lights from a gutter.

DESCRIPTION OF THE PRIOR ART

The use of Christmas light clips is known in the prior art. More specifically, Christmas light clips heretofore devised and utilized are known to consist basically of familiar, expected and obvious structural configurations, notwithstanding the myriad of designs encompassed by the crowded prior art which have been developed for the fulfillment of countless objectives and requirements.

Illustrative examples of such devices include: U.S. Pat. No. 5,388,802; U.S. Pat. No. 5,772,166; and U.S. Pat. No. 6,378,827.

In these respects, the gutter interface device according to the present invention substantially departs from the conventional concepts and designs of the prior art, and in so doing provides an apparatus primarily developed for the purpose of facilitating hanging of Christmas lights from a gutter.

SUMMARY OF THE INVENTION

In view of the foregoing disadvantages inherent in the known types of Christmas light clips now present in the prior art, the present invention provides a new gutter interface device construction wherein the same can be utilized for facilitating hanging of Christmas lights from a gutter.

To attain this, the present invention generally comprises a gutter interface portion and a cord interface portion. The gutter interface portion has a main vertical member for abutting a front edge of the gutter. The gutter interface portion has a lip-engaging member integrally coupled to the main vertical member. The lip-engaging member has a first horizontal extent coupled to said main vertical member, a vertical extent and a second horizontal extent, said lip-engaging member being u-shaped for abutting three sides of a lip of a gutter.

There has thus been outlined, rather broadly, the more important features of an apparatus for facilitating the hanging of holiday lights in order that the detailed description thereof that follows may be better understood, and in order that the present contribution to the art may be better appreciated. There are additional features of the apparatus for facilitating the hanging of holiday lights that will be described hereinafter and which will form the subject matter of the claims appended hereto.

In this respect, before explaining at least one embodiment of the apparatus for facilitating the hanging of holiday lights in detail, it is to be understood that the apparatus for facilitating the hanging of holiday lights is not limited in its application to the details of construction and to the arrangements of the components set forth in the following description or illustrated in the drawings. The apparatus for facilitating the hanging of holiday lights is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present apparatus for facilitating the hanging of holiday lights. It is important, therefore, that the claims be regarded as including such equivalent constructions insofar as they do not depart from the spirit and scope of the present invention.

It is another object of the present invention to provide an apparatus for facilitating the hanging of holiday lights which has all of the advantages of the prior art and none of the disadvantages.

It is another object of the present invention to provide an apparatus for facilitating the hanging of holiday lights which may be easily and efficiently manufactured and marketed.

It is another object of the present invention to provide an apparatus for facilitating the hanging of holiday lights which is of durable and reliable construction.

It is yet another object of the present invention to provide an apparatus for facilitating the hanging of holiday lights which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
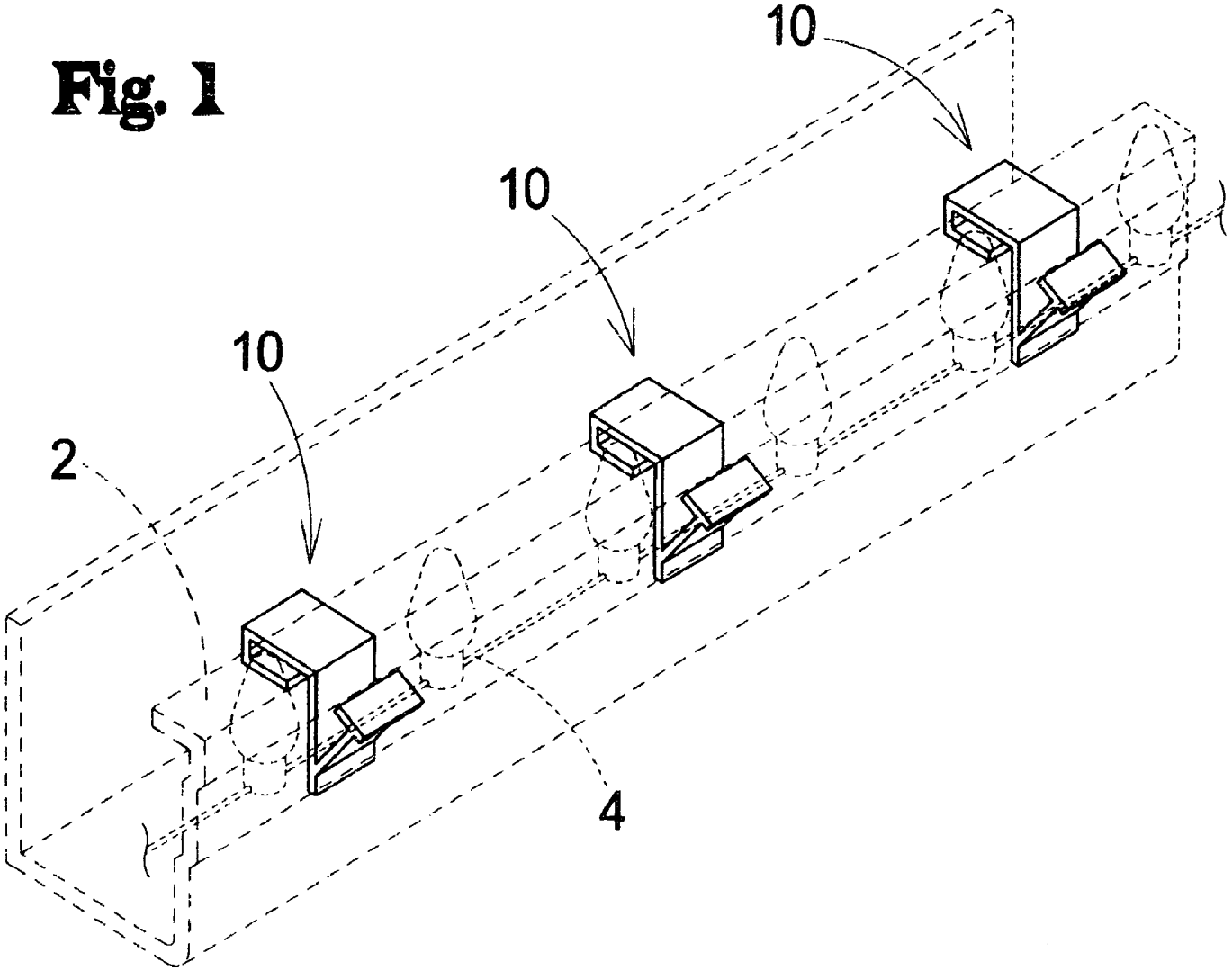
FIG. 1 is a schematic perspective view of a new gutter interface device in use according to the present invention.
Figure 2:
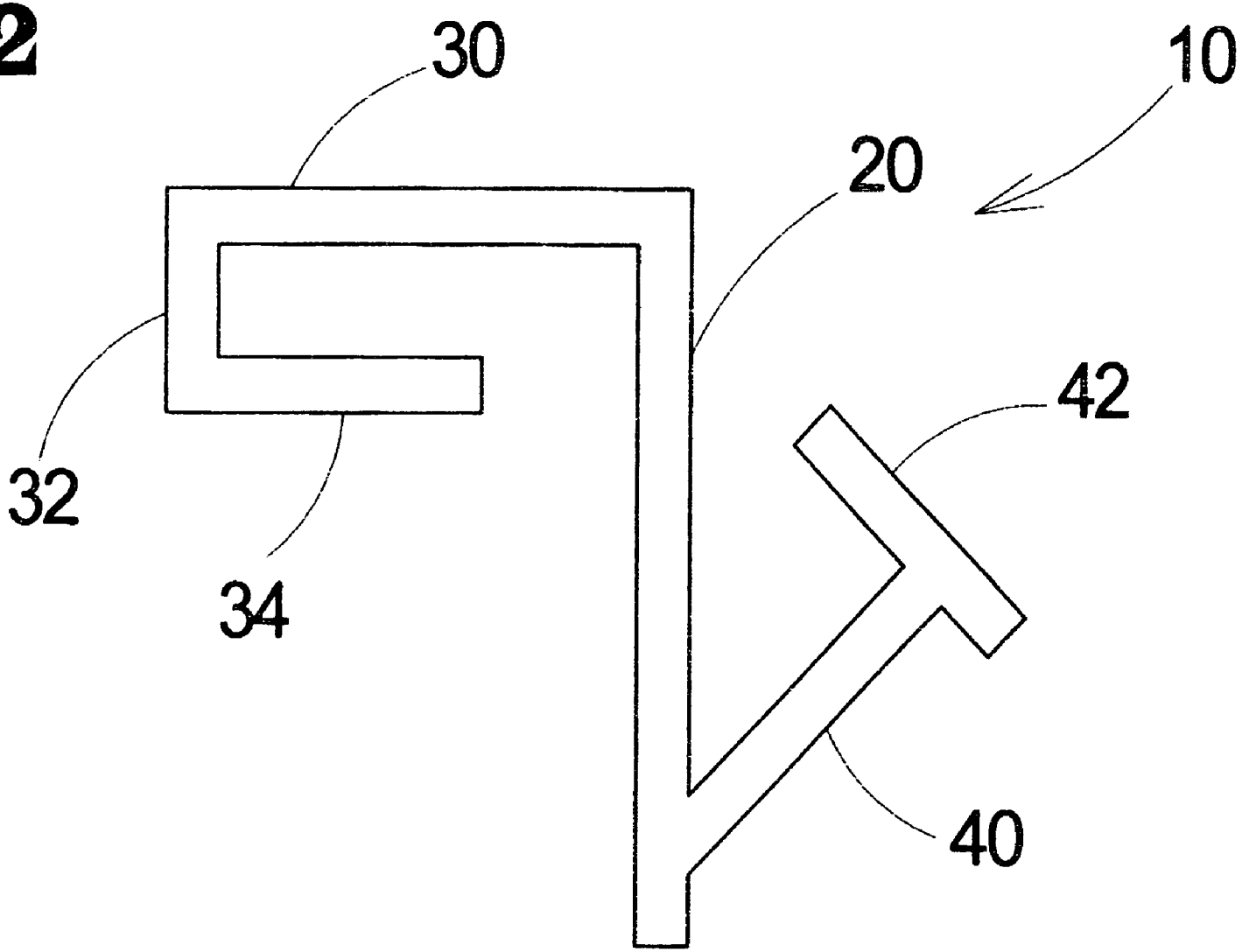
FIG. 2 is a schematic side view of the present invention.

With reference now to the drawings, and in particular to FIGS. 1 and 2 thereof, a new gutter interface device embodying the principles and concepts of the present invention and generally designated by the reference numeral 10 will be described.

As best illustrated in FIGS. 1 and 2, the gutter interface device 10 generally comprises a gutter interface portion and a cord interface portion. The gutter interface portion has a main vertical member 20 for abutting a front edge of the gutter. The gutter interface portion has a lip-engaging member integrally coupled to the main vertical member 20. The lip-engaging member has a first horizontal extent 30 coupled to said main vertical member, a vertical extent 32 and a second horizontal extent 34, said lip-engaging member being u-shaped for abutting three sides of a lip of a gutter.

In an embodiment, the first horizontal extent 30 has a length of one inch, the second horizontal extent 34 has a length of one half inch, and the vertical extent 32 has a length of one quarter inch.

The cord interface portion has a first extent 40 operationally coupled to a lower end of the main vertical member of the gutter interface portion. The first extent 40 extending away from the main vertical member at an oblique angle. The cord interface portion having a second extent 42 coupled to a distal end of said first extent 40. Said second extent 42 extending towards said main vertical extent 20.

Said first extent 40 being for supporting a cord of a string of Christmas lights. Said second extent 42 being for selectively retaining the cord of the string of Christmas lights.

In use, a plurality of gutter interface devices are used to support a string of Christmas lights. Preferably, the devices are positioned approximately 6 inches apart along an edge of the gutter.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gutter interface for selectively coupling decorative lights to a gutter on a structure, the interface comprising:

a gutter interface portion operationally coupleable to a gutter on a structure, and a cord interface portion coupled to said gutter interface portion, said cord interface portion being selectively coupled to a cord on a decorative light whereby the decorative light is selectively coupled to the gutter, wherein said cord interface portion has a first extent operationally coupled to a lower end of the main vertical member of the gutter interface portion said first extent extending away from the main vertical member at an oblique angle, and further wherein said cord interface portion has a second extent coupled to a distal end of said first extent, said second extent extending towards said main vertical extent, said first extent being for supporting a cord of a string of Christmas lights, said second extent being for selectively retaining the cord of the string of Christmas lights.

2. The interface of claim 1, wherein the gutter interface portion further comprises:

a main vertical member for abutting a front edge of the gutter, and a lip-engaging member integrally coupled to the main vertical member.

3. The interface of claim 2, further wherein said lip-engaging member has a first horizontal extent coupled to said main vertical member, a vertical extent and a second horizontal extent, said lip-engaging member being u-shaped for abutting three sides of a lip of a gutter.

4. The interface of claim 3, wherein the first horizontal extent has a length of one inch, the second horizontal extent has a length of one half inch, and the vertical extent has a length of one quarter inch.

5. The interface of claim 1, further wherein said cord interface portion has a first extent operationally coupled to a lower end of the main vertical member of the gutter interface portion, said first extent extending away from the main vertical member at an oblique angle.

6. The interface of claim 5, further wherein said cord interface portion has a second extent coupled to a distal end of said first extent, said second extent extending towards said main vertical extent, said first extent being for supporting a cord of a string of Christmas lights, said second extent being for selectively retaining the cord of the string of Christmas lights.

7. A gutter interface for selectively coupling decorative lights to a gutter on a structure, the interface comprising:

a gutter interface portion operationally coupleable to a gutter on a structure, the gutter interface portion further comprising (i) a main vertical member for abutting a front edge of the gutter, (ii) a lip-engaging member integrally coupled to the main vertical member, said lip-engaging member having a first horizontal extent coupled to said main vertical member, a vertical extent and a second horizontal extent, said lip-engaging member being u-shaped for abutting three sides of a lip of a gutter, wherein the first horizontal extent has a length of one inch, the second horizontal extent has a length of one half inch, and the vertical extent has a length of one quarter inch, a cord interface portion coupled to said gutter interface portion, said cord interface portion being selectively coupled to a cord on a decorative light whereby the decorative light is selectively coupled to the gutter, said cord interface portion having a first extent operationally coupled to a lower end of the main vertical member of the gutter interface portion, said first extent extending away from the main vertical member at an oblique angle, and said cord interface portion having a second extent coupled to a distal end of said first extent, said second extent extending towards said main vertical extent, said first extent being for supporting a cord of a string of Christmas lights, said second extent being for selectively retaining the cord of the string of Christmas lights.

8. A gutter interface for selectively coupling decorative lights to a gutter on a structure, the interface comprising:

a gutter interface portion operationally coupleable to a gutter on a structure, and a cord interface portion coupled to said gutter interface portion, said cord interface portion being selectively coupled to a cord on a decorative light whereby the decorative light is selectively coupled to the gutter, wherein said cord interface portion has a first extent operationally coupled to a lower end of the main vertical member of the gutter interface portion, said first extent extending away from the main vertical member at an oblique angle, and further wherein said cord interface portion has a second extent coupled to a distal end of said first extent, said second extent extending towards said main vertical extent, said first extent being for supporting a cord of a string of Christmas lights, said second extent being for selectively retaining the cord of the string of Christmas lights.

9. The interface of claim 8, wherein the gutter interface portion further comprises:

a main vertical member for abutting a front edge of the gutter, and a lip-engaging member integrally coupled to the main vertical member.

10. The interface of claim 9, wherein the gutter interface portion further wherein said lip-engaging member has a first horizontal extent coupled to said main vertical member, a vertical extent and a second horizontal extent, said lip-engaging member being u-shaped for abutting three sides of a lip of a gutter.

11. The interface of claim 10, wherein the first horizontal extent has a length of one inch, the second horizontal extent has a length of one half inch, and the vertical extent has a length of one quarter inch.

12. The interface of claim 10, further wherein said cord interface portion has a first extent operationally coupled to a lower end of the main vertical member of the gutter interface portion, said first extent extending away from the main vertical member at an oblique angle.

13. The interface of claim 12, further wherein said cord interface portion has a second extent coupled to a distal end of said first extent, said second extent extending towards said main vertical extent, said first extent being for supporting a cord of a string of Christmas lights, said second extent being for selectively retaining the cord of the string of Christmas lights.

* * * * *